United States Patent [19]

Jones

[11] 4,139,989

[45] Feb. 20, 1979

[54] SEALS FOR TUNNELLING SHIELDS

[75] Inventor: David R. Jones, Ossett, England

[73] Assignee: Edmund Nuttall Limited, London, England

[21] Appl. No.: 818,429

[22] Filed: Jul. 25, 1977

[30] Foreign Application Priority Data

Jul. 29, 1976 [GB] United Kingdom ..... 31624/76
Jan. 28, 1977 [GB] United Kingdom ..... 3673/77

[51] Int. Cl.[2] ..... E01G 5/16
[52] U.S. Cl. ..... 405/147
[58] Field of Search ..... 61/84, 85, 42, 45 R, 61/63

[56] References Cited

U.S. PATENT DOCUMENTS

| | | | |
|---|---|---|---|
| 3,410,098 | 11/1968 | Winberg | 61/85 |
| 3,494,136 | 2/1970 | Wilms | 61/85 |
| 3,788,087 | 1/1974 | Patin | 61/84 |
| 3,827,244 | 8/1974 | Walbrohl | 61/42 |
| 3,979,920 | 9/1976 | Burgess et al. | 61/84 |

FOREIGN PATENT DOCUMENTS

| | | | |
|---|---|---|---|
| 1534624 | 1/1969 | Fed. Rep. of Germany | 61/85 |
| 1534625 | 1/1969 | Fed. Rep. of Germany | 61/85 |

*Primary Examiner*—Dennis L. Taylor
*Attorney, Agent, or Firm*—Robert L. Goldberg; George W. Neuner

[57] ABSTRACT

A tail seal for a tunnelling shield, particularly for use in the bentonite process, in which a seal is formed of short brush-like material mounted on a flexible support and resiliently urged by a body of closed cell expanded material, such as neoprene. In a preferred form the flexible support is secured both fore and aft and the closed cell expanded material has an inflatable member embedded therein.

18 Claims, 7 Drawing Figures

SEALS FOR TUNNELLING SHIELDS

This invention relates to seals for tunnelling shields.

U.K. Pat. Specification No. 1,083,322 describes and claims a method of tunnelling using a tunnelling apparatus including a shield containing or supporting a power driven rotary mechanical digging mechanism in front of a bulkhead, in which a liquid thixotropic suspension is delivered under pressure to the space in front of the bulkhead so as to contact the working face on which the digging mechanism acts, and the spoil excavated by the digging mechanism is removed together with a proportion of the liquid suspension.

This method has been coming into practical use for some years, and in practice, the thixotropic suspension is of Bentonite and the type of machine used is referred to as a bentonite tunnelling machine.

In using such a machine, with a high pressure at the working face, it is necessary to have a seal at the tail of the tunnelling shield to prevent leakage round the outside of the shield and into the rear thereof. Hitherto, as described in U.K. Pat. Specification No. 1,417,969, such a seal has been consituted by an annular brush type seal extending round and secured within the shield so that the brush itself bears and seals on the tunnel lining within the rearmost part of the shield. The brush may be applied against the lining by an inflatable pneumatic ring secured by straps to the shield.

Such a tail seal has provided an adequate seal in use, but suffers from the disadvantage that when the advancing jacks are relaxed, the pressure at the working face tends to push the shield away from the face so that the brush, which is formed of long fibres normally laid along the lining and extending rearwardly, is subjected to a reversal of its normal movement and rapidly becomes tangled, resulting in a loss of sealing. For this reason, brush seals at the tail have had to be frequently replaced.

Accordingly the present invention consists in a seal for a tunnelling machine, including a resiliently supported annular sealing member carrying a sealing surface of short brush-form material, the said sealing member being arranged to be resiliently urged into engagement with a co-operating surface, preferably by means of an annular body of closed cell expanded elastomer material, such as a synthetic rubber.

The invention is applicable to the stiff trailing lip type of seal, and also for example to a seal consisting of a ring of flexible material anchored at the leading and trailing edges and carrying a brush type sealing surface. The ring covers an annular body, of closed cell neoprene which is compressed by the ring so as to urge the ring outwardly towards the correspondingly surrounding surface.

If desired the body of closed cell material may include one or more inflatable zones embedded therein.

The use of short brush material at the sealing surface gives a seal which conforms to the somewhat irregular surface to be found on the exterior of the tunnel lining. The brush material is to be mounted on a robust steel or tough elastomer sealing member, and the use of closed-cell expanded elastomer to urge the sealing member against the lining provides resilient urging without the possibility of grout or other material impairing the operation of the resilient urging means, as could happen if inflatable tubes or mechanical springs were used.

Short brush form material, i.e. brush material of which the fibres are sufficiently short and fine to be bistable in operation so as to flick over from one stable position to the other on a reversal of stress has not previously been used for sealing in tunnelling machines. It has been used as a weather seal for doors and sliding windows when the conditions are less arduous, and it has surprisingly been found that it is able to stand-up to the conditions to which a tunnelling machine seal, particularly a tail seal on a bentonite machine, is subjected. The short fibres need to be closely bunched together to form an effective barrier to the flow of bentonite suspension or other materials against which sealing is desired. It is also clear that by using short material, the tangling problem met with in long brush fibres is also avoided in that the fibres flick over to the alternate position on a reversal of motion.

A further advantage arising is that a long fibre brush is susceptible to considerable damage if some of the fibres are allowed to set into grouting. The length of the fibres means that a considerable force has to be exerted to free the fibres and this force may break the fibres or pull them out of the anchorage. If short fibres are set in grout then the force involved is smaller and therefore less damage to the seal occurs from this cause.

The seal will normally be mounted within a shield to bear on a tunnel lining within the shield.

According to a second aspect of the invention there is provided a tunnelling shield having a tail seal as set forth above mounted thereon.

An annular trailing lip seal is preferably made in sections, e.g. four in number each covering 90°, lap-jointed together.

The trailing lip sealing member may be formed of a solid polyurethane.

In a preferred embodiment, the tail seal is duplicated to provide a rear tail seal in tandem with a forward tail seal. The rear tail seal in such an arrangement may be formed by a lip seal at the sealing surface, rather than by a brush.

The invention will be further described with reference to the accompanying drawings which show various embodiments of the invention, and in which FIG. 1 is a diagrammatic section, to a reduced scale, on the line I—I of FIG. 2;

Figure 1:
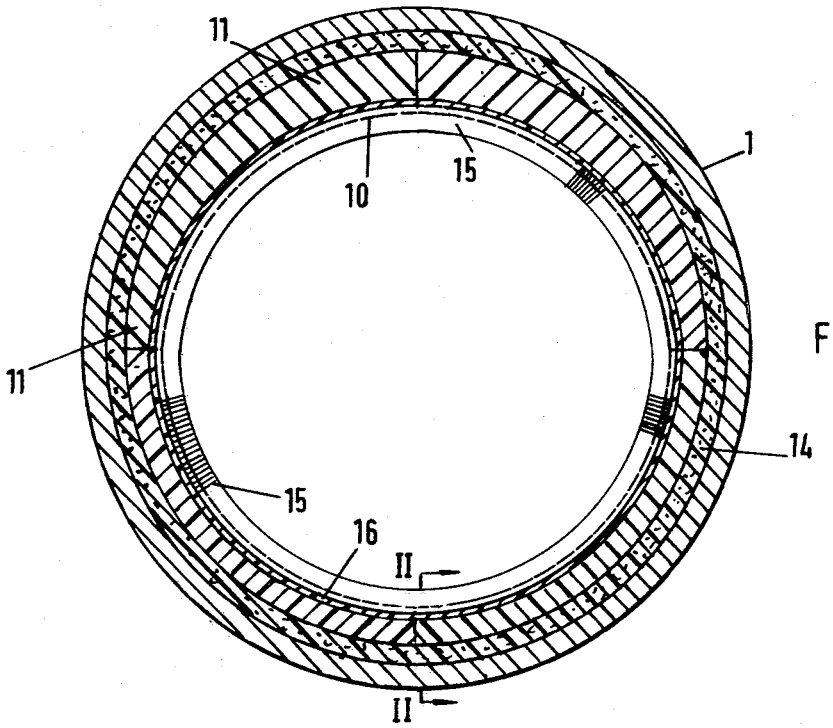
Figure 2:
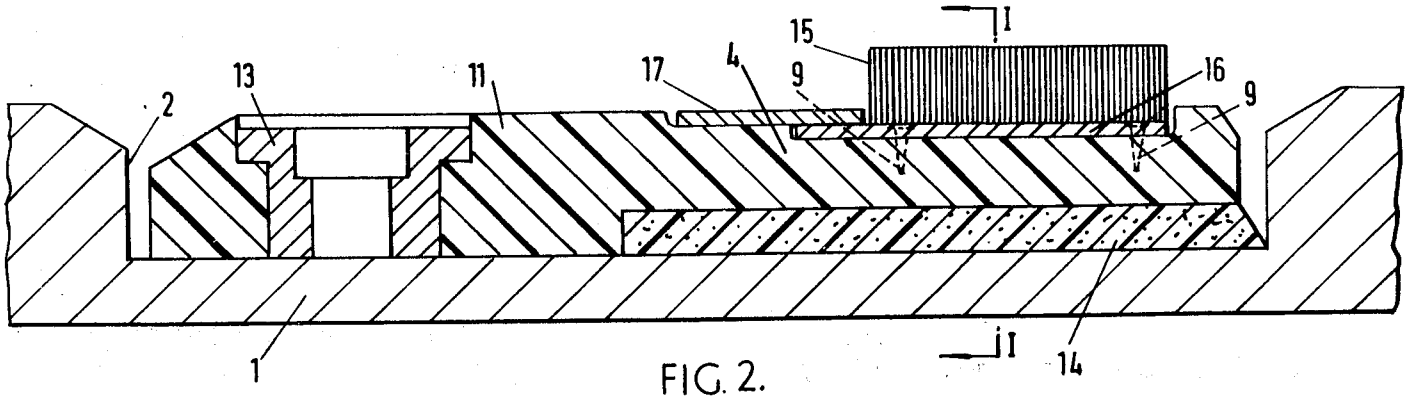
FIG. 2 is a sectional view to an enlarged scale drawing on the line II—II of FIG. 1, showing a form of tail seal according to one form of the invention.

Turning first to FIGS. 1 and 2 there is shown the rear portion 1 of a tunnelling shield which is provided with a recess 2 for housing a tail seal. The tail seal consists of a body 11 of durable resilient material such as moulded polyurethane with Shore hardness of about 80, which is provided with metal inserts 13 by which it can be securely screwed to the shield 1. A portion 4 of the body 11 is arranged to be spaced from the shield 1, and the space so formed is inflatably filled with a body 14 of closed cell expanded elastomer, such as expanded neoprene. The body 11 thus forms a stiff trailing lip seal. The sealing face of the portion 4 is provided with a sealing surface, which is illustrated as being in the form of a continuous brush element extending around the ring shaped body of the seal. A typical commercially available material consists of closely packed nylon bristles 15, e.g. 16mm long, set in a polyurethane base 16. The bristles are short enough and firm enough to be bistable so as to take up an inclined trading position for each direction of motion and to flick from one position to the other on a reversal of motion. The sealing surface is indicated by the reference numeral 8, and screws indicated by 9 are placed at intervals around the ring to hold the sealing surface in place. The back 16 is retained in the body 11 by means of metal strips 17.

For the particular application for which this seal is designed, the tunnel lining is not exactly co-axial with the tunnelling machine, so that the sealing is not required on a circle, but is in fact slightly flattened at the top. In order to accommodate this variation, the portion 4 of the body is thicker as indicated at 11 in FIG. 1 at the top of the tunnel than at the bottom.

If desired, a second or forward tail seal may be provided in a further recess.

The seal here is essentially similar to that already described, and detailed description will not be given. The shape of the recess is slightly different in that it may have two vertical sides rather than one tapered side.

Figure 7:
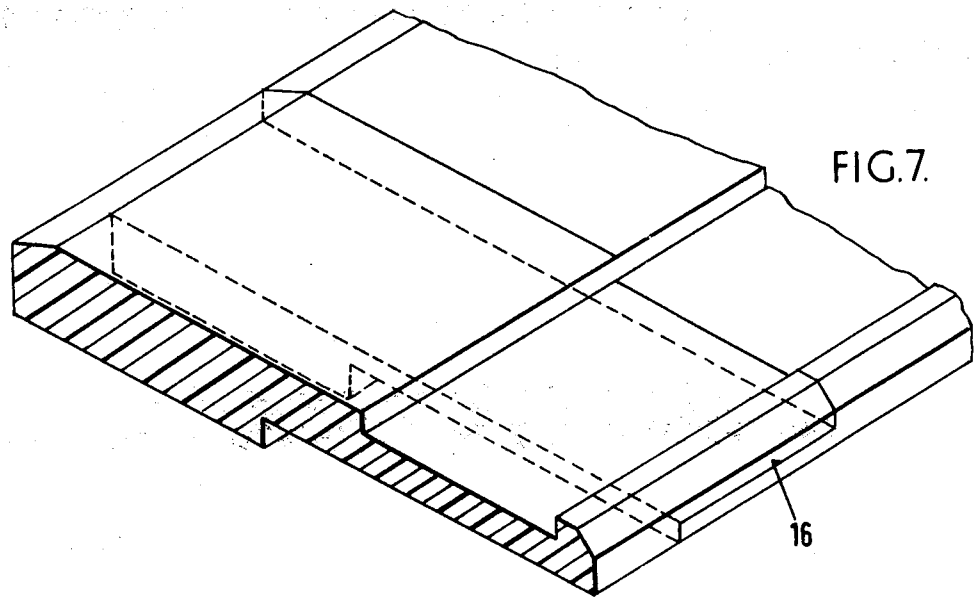
FIG. 7 is an isometric view illustrating a joint between sections of a tail seal.

In order to keep the pieces of the seal down to manageable size, and also to improve its deflectability it is preferred that the tail seal body should be made in sections, e.g. four in number each covering a 90° arc. The joints between the sections are illustrated in FIG. 1 by lines 51, and it can be seen from FIG. 7 that adjacent the joint lines, the sections of the body are rebated to provide a lap joint as indicated at 52.

Figure 3:
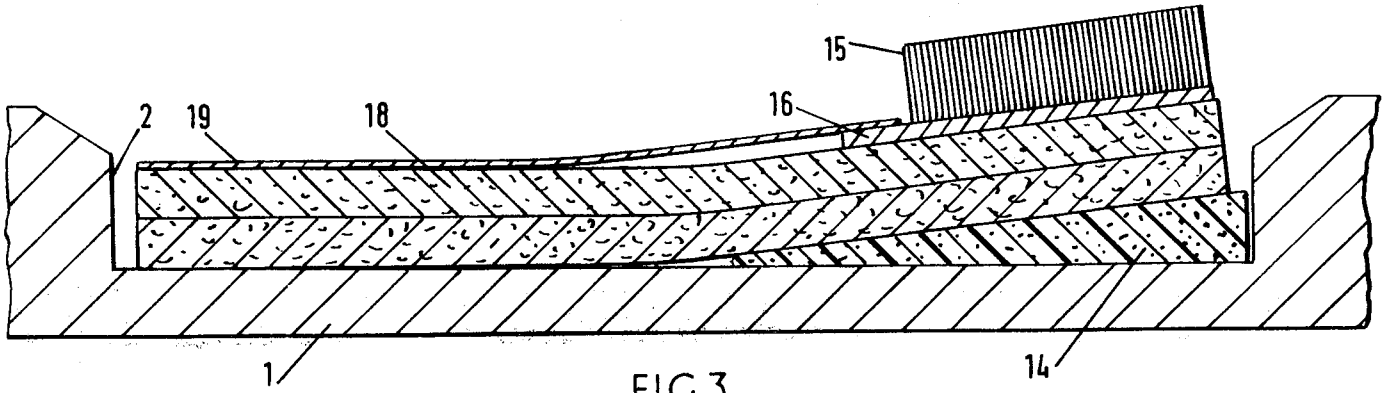
FIGS. 3 to 6 are views similar to FIG. 2 showing alternate forms of embodiment.

Turning now to FIG. 3, there is shown a stiff trailing lip seal in which the trailing lip itself is formed by fabric reinforced elastomer material similar to that used for conveyor belting. THe body 18 illustrated is formed of two layers of such conveyor belting material, each three-eighth inch thick and bonded together. The body 18 is again held down to the tunnelling shield 1 by screws (not shown) which pass through mild steel flaps 19 which not only serves to protect the material of the body 18, but also function in the same way as the strips 17 to engage and protect the leading edge of the back 16 supporting the brush material 15. THe body 18 is urged in the sealing direction by means of a body of expanded neoprene 14. It will be seen that this seal is also a stiff trailing lip type of seal.

Figure 4:
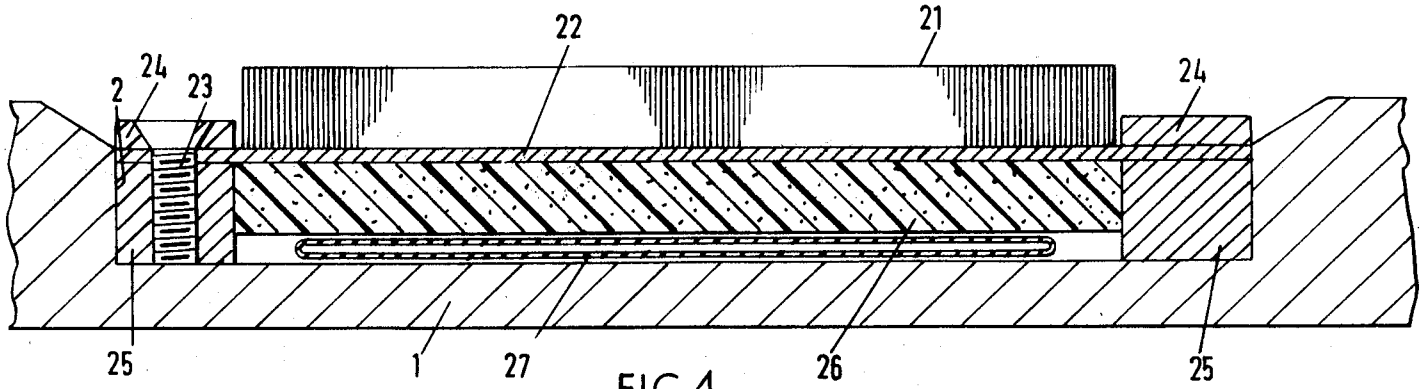

FIG. 4 shows a different form of seal in which both the leading and trailing edges of the seal are anchored. A wide strip 21 of short brush material, e.g. 16mm nylon or similar brush material, set in a steel or elastomer back 22 has the back 22 anchored at both leading and trailing edges by means of screws 23 set at appropriate spacings around the periphery of the seal. These screws pass through fixing strips 24, the back 22 and into securing blocks 25. THe securing blocks may vary in height around the periphery of the tunnelling shield 1 to provide proper spacing of the brush material 21 from the tunnel lining.

Within the cavity defined between the brush back 22 and the tunnelling shield 1, there is located a body 26 of closed cell expanded elastomer material in a partially compressed state so as to urge the brush material into engagement with the surface against which it is to seal, and the effect of this material is augmented by an inflatable expansion ring 27, which may be formed from 150mm flat hose, similar to that used for fire hoses.

Figure 5:
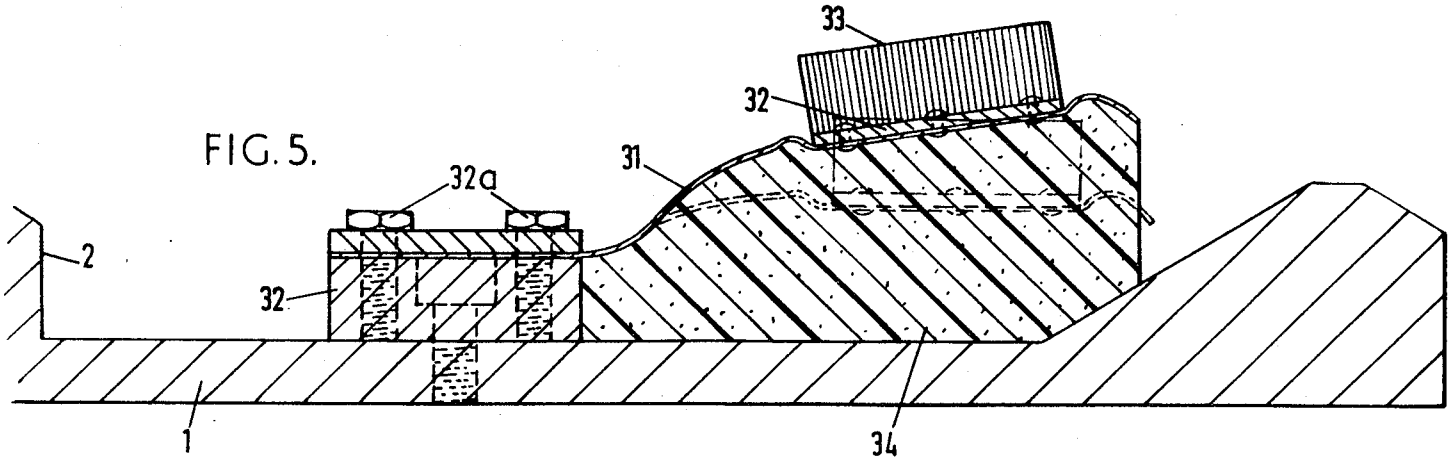

In the embodiment of the invention shown in FIG. 5, a stiff trailing lip seal is provided by a spring steel lip 31 secured at its forward end by screws **32*a* to mounting block 32 themselves mounted on the tunnelling shield 1. The lip 31 carries, in a cavity provided for the purpose, the backing 32 of short brush material 33, and is urged towards the outer position shown in full lines by an annular means 34** of closed cell expanded elastomer material, e.g. expanded neoprene.

Figure 6:
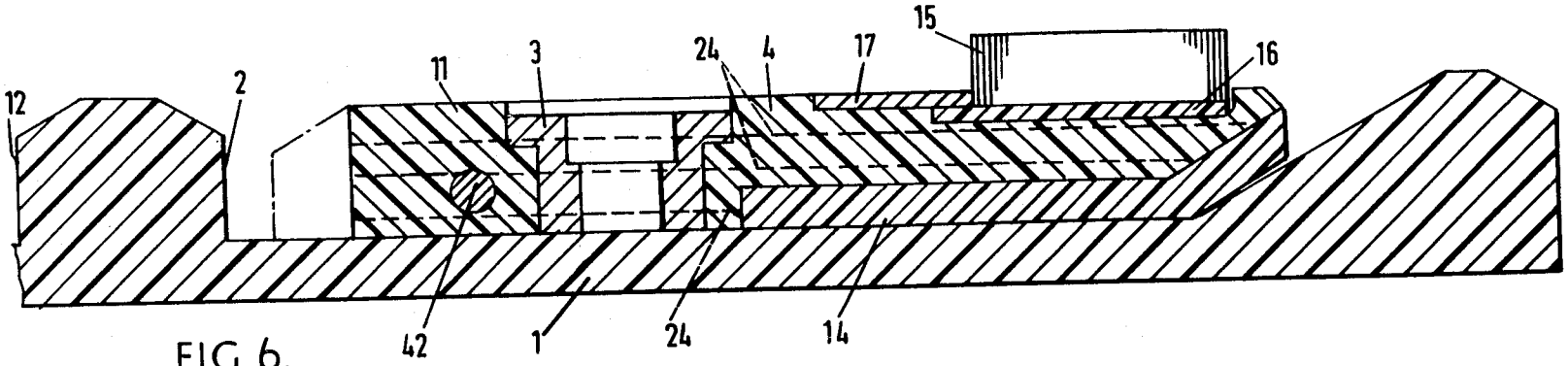

FIG. 6 shows the rear portion of a tunnelling shield provided with a recess 2 housing a rear tail seal and also shows a portion of a second recess 12 for housing a forward tail seal (not shown). The tail seals are generally similar to those described with reference to FIG. 2 above, with certain modifications.

The forward ends of the tail seal body sections are linked by a ring 42 of wire rope for reinforcement.

Further the body 11 is reinforced with expanded metal sheet 44 embedded in the moulded material as indicated.

Various other modifications may be made within the scope of the invention. For example, the brush form material may have the fibres looped through a thick body, e.g. one-half inch thick, of fabric-reinforced elastomer and the loops on the reverse side may be secured by wire, e.g. of stainless steel.

I claim:

1. In a seal, particularly a tail seal, for a tunnelling machine shield, of the type including a resiliently supported annular sealing member and an annular body of closed cell expanded elastomer material to urge the said sealing member into engagement with a cooperating surface: the improvement that the sealing member carries a sealing surface formed by short brush form material having brush fibres that are oriented substantially perpendicular to said cooperating surface prior to engagement therewith and are deflected from the perpendicular upon engagement with said cooperating surface, and that are sufficiently short and fine to be bistable in operation and to preclude the free ends of the fibres from extending parallel to said cooperating surface.

2. A seal as claimed in claim 1, in which the annular body is of synthetic rubber.

3. A seal as claimed in claim 1, in which the sealing member is a stiff trailing lip seal.

4. A seal as claimed in claim 1, in which the sealing member is a body of solid elastomer material having a first region adapted to be secured to the tunnelling shield and a second region in the form of a trailing lip spaced from the shield, with the body of closed cell expanded elastomer material located in the space between the shield and the lip.

5. A seal as claimed in claim 4, in which the surface of short brush form material includes a sealing surface and a backing, and the lip includes metal strips which engage the body to secure the brush form material to the lip.

6. A seal as claimed in claim 4, comprising expanded metal reinforcement in the body of solid elastomer material.

7. A seal as claimed in claim 3, in which the sealing member is a body built up from layers of fabric-reinforced elastomer material bonded together.

8. A seal as claimed in claim 7, in which the surface of short brush form material includes a backing, and in which the exposed surface of the fabric referred to as elastomer material is covered by metal flaps which hold the body in position.

9. A seal as claimed in claim 3, in which the sealing member is a spring steel lip.

10. In a seal, particularly a tail seal for a tunnelling machine shield, of the type including a resiliently supported annular sealing member and means for resiliently urging the sealing member into engagement with a cooperating surface: the improvement that the sealing member carries a sealing surface formed by short brush form material having brush fibres that are oriented substantially perpendicular to said cooperating surface prior to engagement therewith and are deflected from the perpendicular upon engagement with said cooperating surface, and that are sufficiently short and fine to be bistable in operation and to preclude the free ends of the fibres from extending parallel to said cooperating surface, and that the sealing member has leading and trailing edges each anchored to the shield and is held spaced from the shield between these edges by the resilient urging means.

11. A seal as claimed in claim 10, in which the urging means consists of a body of closed cell expanded elastomer material.

12. A seal as claimed in claim 11, comprising an inflatable expansion ring embedded inside the expanded elastomer material to augment the urging thereof.

13. A tail seal as claimed in claim 1, in which the ring is made in sections lap-jointed together.

14. A tail seal as claimed in claim 13, comprising a ring of wire rope linking the sections.

15. A seal as claimed in claim 1, in which the short brush form material is formed of nylon bristles secured in a base of tough wear resistant material.

16. In a tunnelling shield having a tail seal mounted thereon, the seal being of the type including a resiliently supported annular sealing member and an annular body of closed cell expanded elastomer material to urge the said selaing member into engagement with a cooperating surface: the improvement that the sealing member carries a sealing surface formed by short brush form material having brush fibres that are oriented substantially perpendicular to said cooperating surface prior to engagement therewith and are deflected from the perpendicular upon engagement with said cooperating surface, and that are sufficiently short and fine to be bistable in operation and to preclude the free ends of the fibres from extending parallel to said cooperating surface.

17. A tunnelling shield as claimed in claim 16, in which the tail seal is mounted in a recess in the outer surface of the shield.

18. A tunnelling shield as claimed in claim 16, which has a rear tail seal in tandem with a forward tail seal.

* * * * *